US009498983B1

(12) United States Patent
Goto

(10) Patent No.: US 9,498,983 B1
(45) Date of Patent: Nov. 22, 2016

(54) PRINTING APPARATUS THAT CUTS OFF A PRINTED PORTION OF AN UNWOUND SHEET AND METHOD FOR PRINTING AN IMAGE

(71) Applicant: TOSHIBA TEC KABUSHIKI KAISHA, Tokyo (JP)

(72) Inventor: Takashi Goto, Fuji Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/869,549

(22) Filed: Sep. 29, 2015

(51) Int. Cl.
*B41J 11/66* (2006.01)

(52) U.S. Cl.
CPC ..... *B41J 11/663* (2013.01); *B41J 11/666* (2013.01)

(58) Field of Classification Search
CPC ..... B41J 11/42; B41J 11/66; B41J 11/68; B41J 11/70; B41J 11/663; B41J 11/666; B41J 15/04; B41J 15/042; B41J 15/18; B41J 17/02; B41J 17/24
USPC ..... 347/16, 104, 108, 152, 157, 171, 218, 347/221; 400/621
See application file for complete search history.

(56) References Cited

U.S. PATENT DOCUMENTS 5,017,945 A * 5/1991 Sasai ..... B41J 11/42 346/136
6,592,217 B2 * 7/2003 Tanaami ..... B41J 11/0075 226/143
6,885,390 B2 * 4/2005 Hoshino ..... B65C 9/25 347/171
7,104,713 B2 * 9/2006 Hoshino ..... B41J 15/005 347/171

FOREIGN PATENT DOCUMENTS

JP 2015139953 A 8/2015

* cited by examiner

*Primary Examiner* — Anh T. N. Vo
(74) *Attorney, Agent, or Firm* — Patterson & Sheridan, LLP

(57) ABSTRACT

A printing apparatus includes a housing, a conveying unit configured to unwind a portion of a rolled sheet and convey the unwound sheet, a printing unit configured to print an image on the unwound sheet, a cutter configured to cut off a portion of the unwound sheet, and a sheet sensor configured to detect a portion of the unwound sheet conveyed out of the housing and, upon detecting the portion, output a detection signal that causes the cutter to cut off the unwound sheet.

19 Claims, 9 Drawing Sheets

PRINTING APPARATUS THAT CUTS OFF A PRINTED PORTION OF AN UNWOUND SHEET AND METHOD FOR PRINTING AN IMAGE

FIELD

Embodiments described herein relate generally to a printing apparatus and method for printing an image on an unwound portion of a rolled sheet.

BACKGROUND

In the related art, a printing apparatus prints an image on an unwound portion of a rolled sheet and cuts off the printed portion. One type of the sheet is a label sheet that includes an adhesive layer to be attached to an object, and a liner-less label, on which the adhesive layer is exposed when being unwound, is known as the label sheet. When the liner-less label is used for printing, the cut-off portion of the liner-less label falls down due to its own weight and may be stuck to an unexpected location.

DETAILED DESCRIPTION

One or more embodiments provide a printing apparatus and method that enables a liner-less label to be cut off at an arbitrary location.

In general, according to one embodiment, a printing apparatus includes a housing, a conveying unit configured to unwind a portion of a rolled sheet and convey the unwound sheet, a printing unit configured to print an image on the unwound sheet, a cutter configured to cut off a portion of the unwound sheet, and a sheet sensor configured to detect a portion of the unwound sheet conveyed out of the housing and, upon detecting the portion, output a detection signal that causes the cutter to cut off the unwound sheet.

First Embodiment

Hereinafter, a first embodiment will be described in detail with reference to the drawings.

Figure 1:
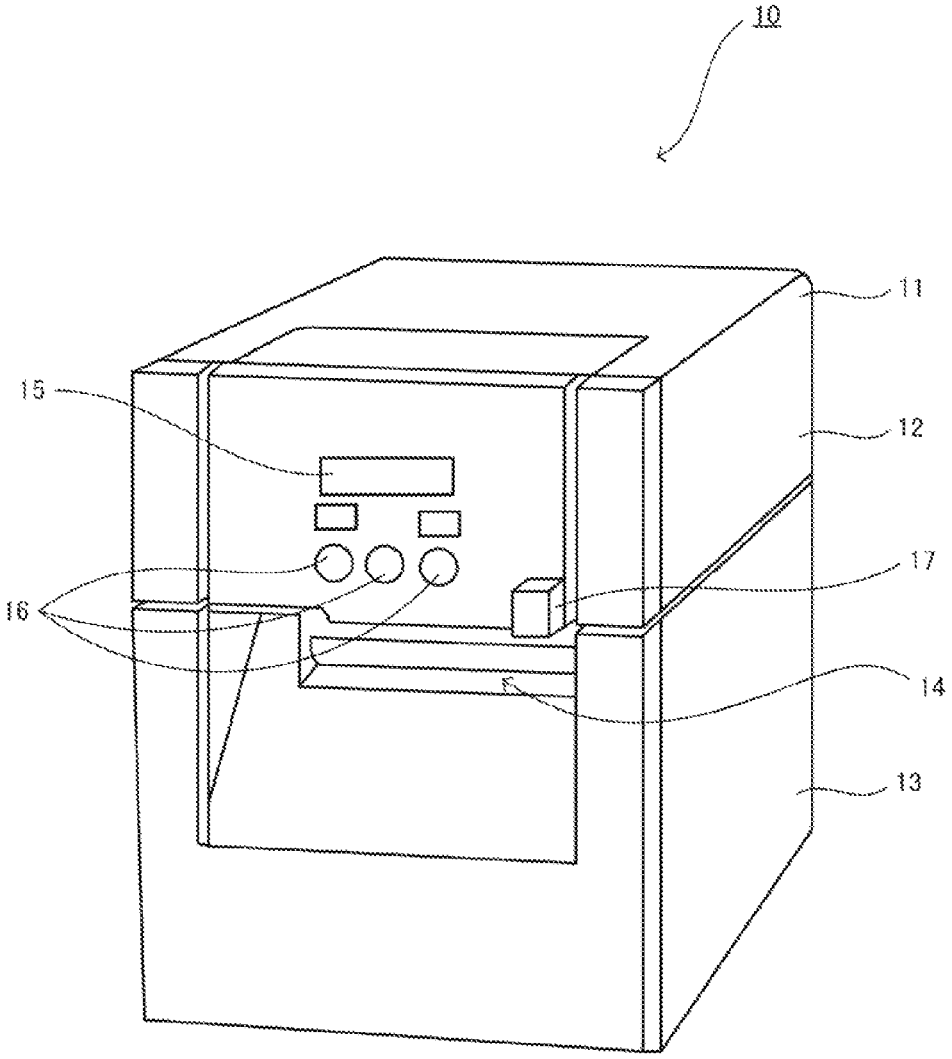
FIG. 1 is an external perspective view of a printing apparatus according to a first embodiment.
Figure 2:
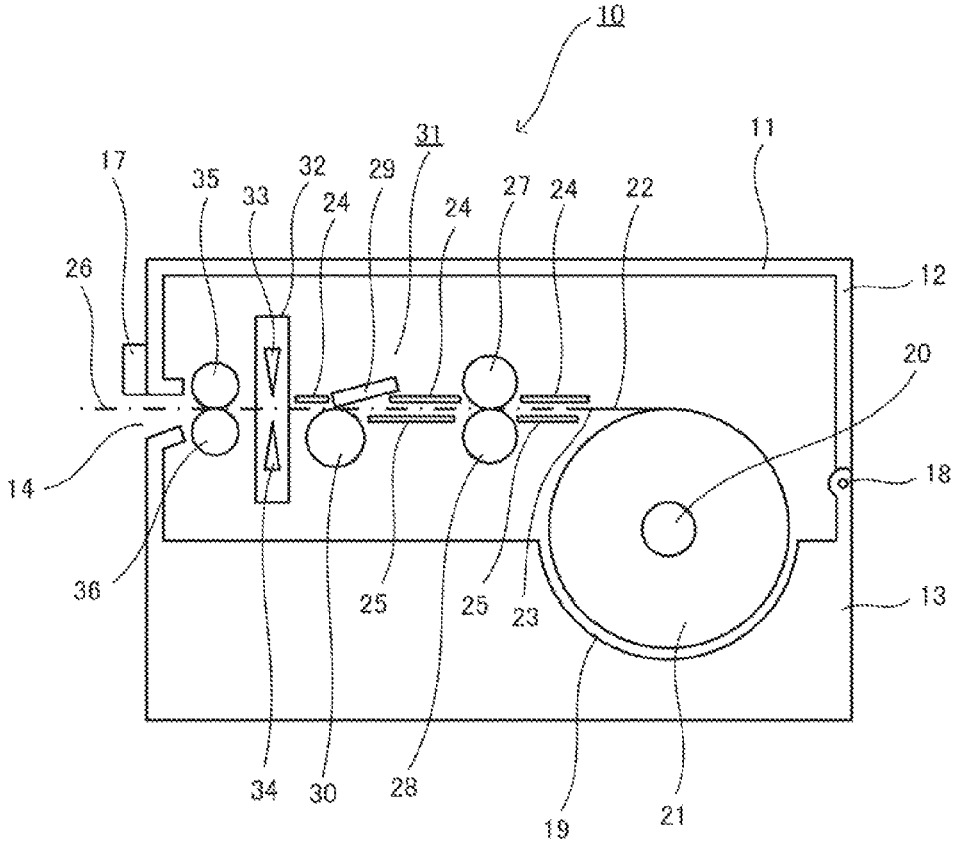
FIG. 2 is a side view of main units of the printing apparatus according to the first embodiment.

FIG. 1 illustrates an external perspective view of a printing apparatus 10, and FIG. 2 illustrates a configuration of main units of the printing apparatus 10. Moreover, in the printing apparatus 10, since an unwound portion of a long label sheet 21 wound in a roll shape is transported from a right side to a left side in FIG. 2, in the following description, the right side in FIG. 2 is referred to as an upstream side and the left side in FIG. 2 is referred to as a downstream side.

The printing apparatus 10 includes a housing 11 having substantially a cubic shape, and the housing 11 is configured of an upper housing 12 and a lower housing 13.

An outlet 14 for discharging the label sheet 21 on which the printing is completed (described below), from the printing apparatus 10, is provided on a front side of the printing apparatus 10. Furthermore, a display unit 15 that informs a user of a state of the printing apparatus 10, an operation unit 16, such as buttons for various settings of the printing apparatus 10, and a cut sensor 17 are provided on an upper side of the outlet 14.

The upper housing 12 and the lower housing 13 are openably connected through a rotation shaft 18. It is possible to set the label sheet 21 to a winding shaft 20 of a storage unit 19 provided inside the lower housing 13 by opening the upper housing 12 around the rotation shaft 18. The label sheet 21 has a print surface 22 having a color development layer that develops a color by heating and has an adhesive layer 23 on a surface opposite to the print surface 22.

A transport upper guide 24 and a transport lower guide 25, which is provided on a lower side of the transport upper guide 24, are provided on the downstream side of the label sheet 21, and extend towards the outlet 14. The label sheet 21 is transported in a medium transport path 26 between the transport upper guide 24 and the transport lower guide 25.

A feed roller 27 capable of being rotated by a motor (not illustrated) and an idler roller 28 disposed opposite to the feed roller 27 across the medium transport path 26 are disposed along the medium transport path 26. The feed roller 27 and the idler roller 28 are paired and transport the label sheet 21 along the medium transport path 26. Moreover, a plurality of pairs of the feed rollers 27 and idler rollers 28 may be provided along the medium transport path 26.

Furthermore, a thermal print head 29 and a platen roller 30 that is disposed opposite to the thermal print head 29 across the medium transport path 26 are disposed downstream with respect to the feed roller 27 along the medium transport path 26. The platen roller 30 is rotatably provided by a motor (not illustrated). The thermal print head 29 and the platen roller 30 configure a printing unit 31.

A cutter 32 is provided downstream with respect to the printing unit 31. The cutter 32 has a movable blade 33 and a fixed blade 34, and a sheet 11 conveyed into a slit (not illustrated) of the cutter is cut by slidingly moving the movable blade 33 toward the fixed blade 34 by driving a motor (not illustrated).

Here, the cutter 32 is described as a so-called slide-type cutter in which the movable blade 33 is slidingly moved toward the fixed blade 34, but is not limited to this type, and the cutter 32 may be a rotary-type cutter in which the movable blade comes into rotational contact with the fixed blade to cut the sheet.

A discharge roller 35 capable of being rotated by a motor (not illustrated) and an idler roller 36 disposed opposite to the discharge roller 35 across the medium transport path 26 are disposed downstream with respect to the cutter 32.

Furthermore, the outlet 14 is provided downstream with respect to the discharge roller 35 and the label sheet 21 on which predetermined printing is completed is discharged outside the printing apparatus 10 from the outlet 14 by the discharge roller 35 and the idler roller 36. The feed roller 27 and the idler roller 28 may also rotated to discharge the label sheet 21.

Figure 3:
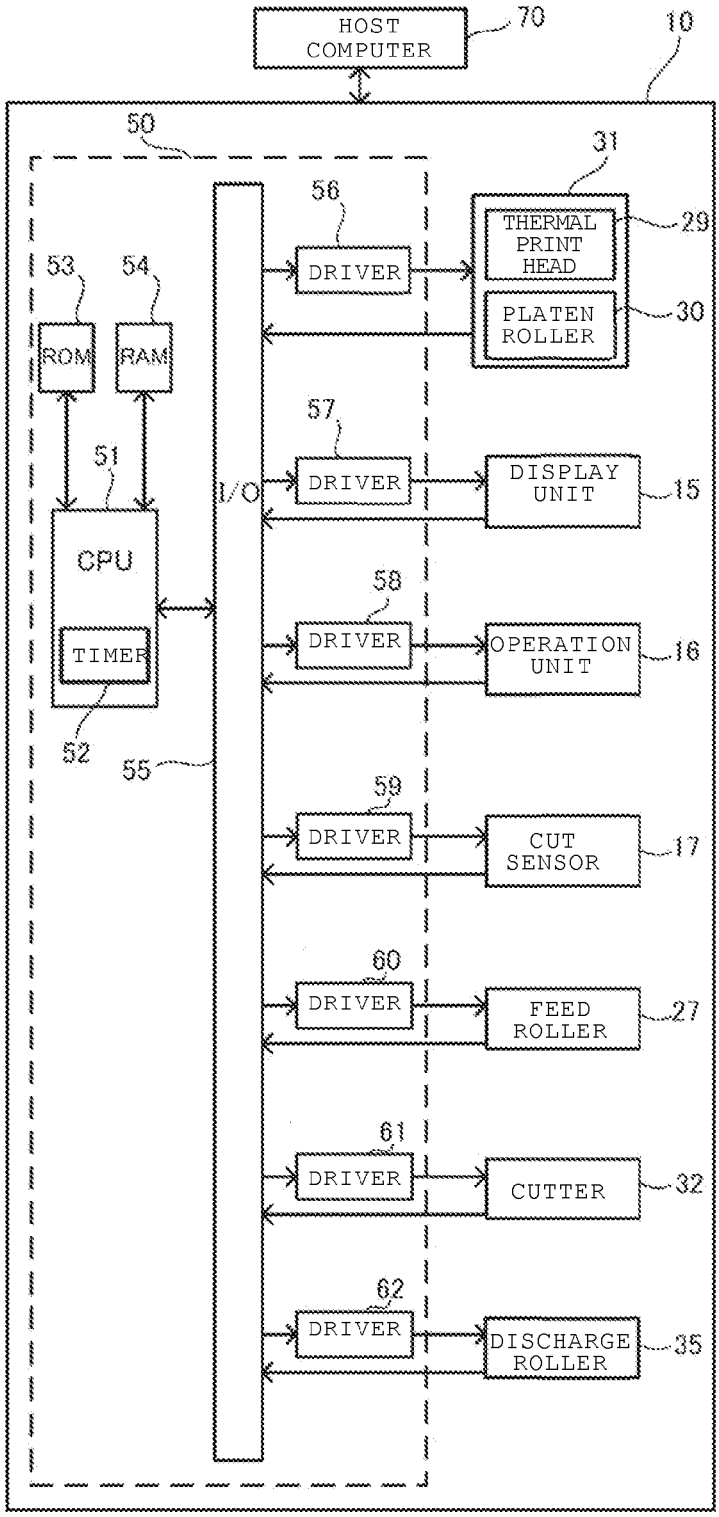
FIG. 3 is a block diagram of control units of the printing apparatus according to the first embodiment.

FIG. 3 illustrates a control unit 50 of the printing apparatus 10 described above. The control unit 50 includes units for performing each control of the transport, printing, cutting, discharging of the label sheet, displaying a state of the printing apparatus, performing various setting operations of the printing apparatus, delivering a cut starting instruction of the label sheet, and the like.

The control unit 50 is configured of, for example, a microcomputer performing communication with a host computer 70 and execution of various control programs. A central processing unit (CPU) 51 of the control unit 50 operates to perform transportation of the label sheet, control of the printing, control of cutting, control of discharging, control of displaying the state of the printing apparatus, performing various setting control programs of the printing apparatus by an operation unit, control of starting to cut the label sheet, and the like according to a control program. Furthermore, the CPU 51 includes a timer 53 as a unit for performing time setting and time control.

A ROM 53 and a RAM 54 as a main storage unit storing a control program executed by the CPU 51, data and the like used in the process of executing the control program are provided. The ROM 53 is a read only memory that stores the control program and the like, and the RAM 54 is a writable memory in which data and the like to be used during the calculation is writable at any time.

Furthermore, the control unit 50 includes an input/output unit (I/O) 55 performing various inputs from the host computer 70 or various outputs to the host computer 70. The I/O 55 is connected to the CPU 51, the ROM 53, and the RAM 54, through a bus.

Furthermore, the I/O 55 is connected to a first, second, third, fourth, fifth, sixth, and seventh drivers 56, 57, 58, 59, 60, 61, and 62 as units for taking out control output.

The first driver 56 supplies necessary driving output to the printing unit 31. The second driver 57 supplies display driving output causing the display unit 15 to perform various displays. The third driver 58 reflects conditions set by the operation unit 16 to the printing apparatus 10. The fourth driver 59 confirms the cutting signal from the cut sensor 17 and supplies the cutting signal to the CPU 51. The fifth driver 60 supplies the driving output to the feed roller 27. The sixth driver 61 supplies the driving output to the cutter 32. The seventh driver 62 supplies the driving output to the discharge roller 35.

Hereinafter, issuance of a label by the printing apparatus 10 according to the first embodiment will be described with reference to FIGS. 4 to 8.

The label sheet 21 is mounted on the storage unit 19 of the printing apparatus 10, such that a leading end portion thereof is drawn out and is pinched between the uppermost pair of the feed roller 27 and the idler roller 28. Next, the printing apparatus 10 receives the printing data from the host computer 70 (S1). Next, the control unit 50 drives the feed roller 27 to transport the label sheet 21 to the printing unit 31 between the feed roller 27 and the idler roller 28 (S2). Next, the control unit 50 turns on the thermal print head 29 and performs the printing on the print surface 22 of the label sheet 21 while transporting the label sheet 21 (S3). Here, in the embodiment, the printing is performed on the label sheet 21 having the color development layer that develops the color by heating. When the label sheet having no color development layer is alternatively used, an ink ribbon can be used for the printing. In this case, the ink ribbon is positioned between the label sheet and the thermal print head 29, and the ink thereon is melted and transferred to the surface of the label sheet.

When the printing on the print surface 22 of the label sheet 21 is completed, the control unit 50 transports the label sheet 21 to the downstream side by the feed roller 27 and the idler roller 28, and then by the discharge roller 35 and the idler roller 36 (S4). Then, the transport is stopped at the cutting position of the label sheet 21 (S5).

Next, the control unit 50 determines whether or not the detection signal is output from the cut sensor 17 (S6). Hereinafter, the cut sensor 17 will be described in detail with reference to FIGS. 6 to 8.

Figure 4:
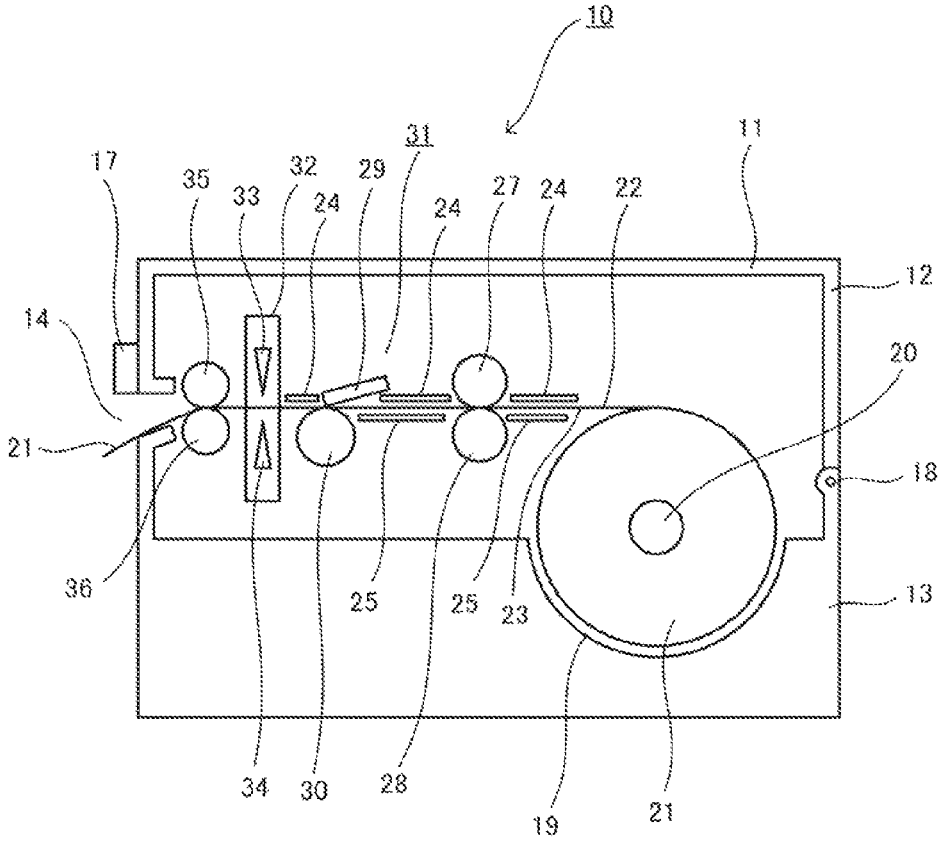
FIG. 4 is a side view of the printing apparatus according to the first embodiment when a sheet is ready to be cut off.
Figure 5:
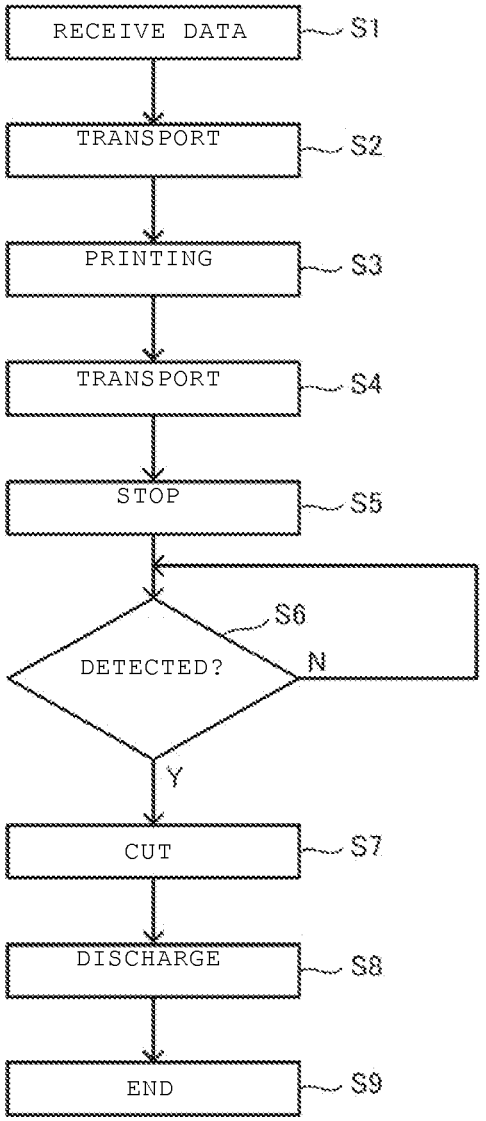
FIG. 5 is a flowchart illustrating a method for publishing a label of the printing apparatus according to the first embodiment.

A state where the transport of the label sheet 21 on which the printing is completed is stopped at the cutting position (S5) is illustrated in FIG. 4. In this state, the label sheet 21 has not been cut by the cutter 32. Thus, the label sheet 21 on which the printing is completed is hanging down due to its own weight, but does not fall.

In this state, the control unit 50 determines whether a cut signal instructing to cut the label sheet 21 from the cut sensor 17 is detected (S6). When the cut signal is not detected (N of S6), the process waits until the cut signal is detected.

Figure 6:
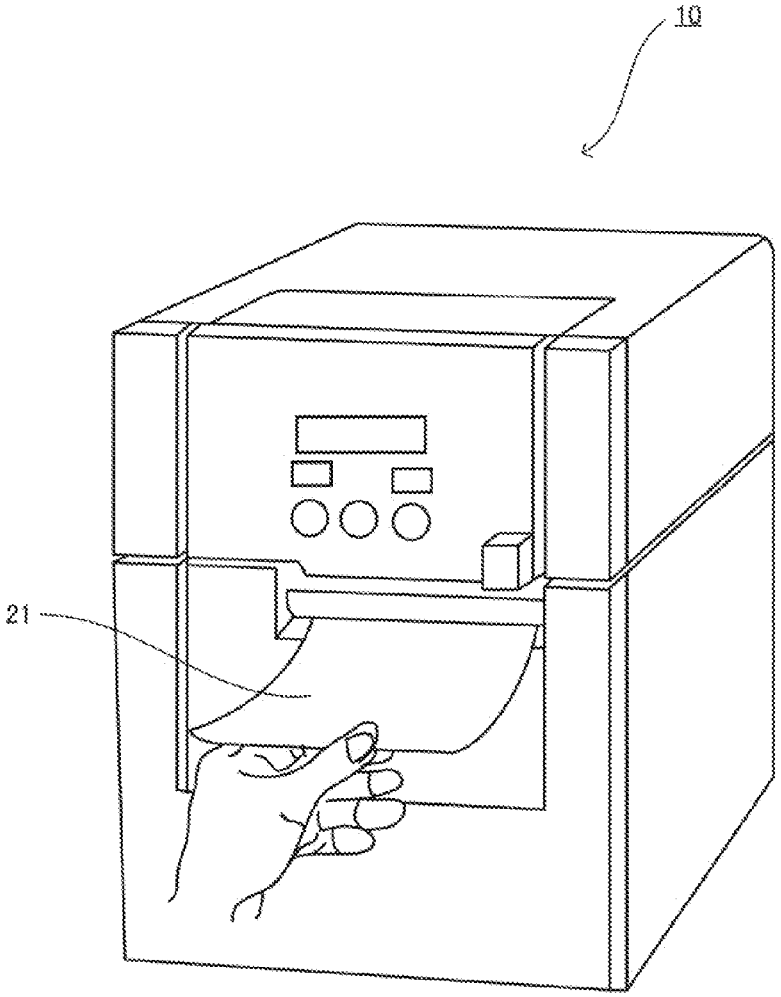
FIG. 6 is an external perspective view of the printing apparatus according to the first embodiment when a label sheet is cut off.
Figure 7:
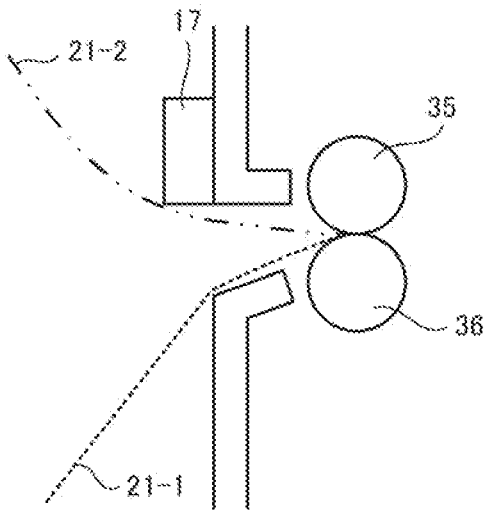
FIG. 7 is an enlarged cross-sectional view of the printing apparatus according to the first embodiment when the label sheet is cut off.
Figure 8:
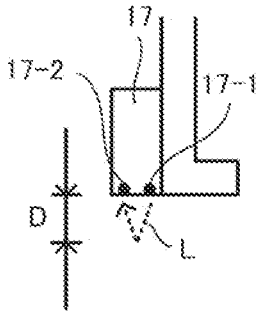
FIG. 8 is a cross-sectional view of a cut sensor in the printing apparatus according to the first embodiment.

In order for the label sheet 21 to be issued as a label capable of being attached, as illustrated in FIG. 6, the user of the printing apparatus 10 needs to hold and lift up the label sheet 21 that is hanging down. FIG. 7 illustrates states where the label sheet 21 is hanging down (21-1) and is held and lifted up (21-2). The hanging-down label sheet 21-1, on which the printing is completed is illustrated by a dotted line and the lifted up sheet 21-2 by the user is illustrated by a two-dotted chain line. As illustrated in FIG. 8, the cut sensor 17 is a reflective-type sensor and includes a light emitting unit 17-1 and a light receiving unit 17-2. When the label sheet 21 is present within a detectable range D, detection light L emitted from the light emitting unit 17-1 is reflected by the sheet within the range D and is incident on the light receiving unit 17-2. When the detection light L is incident on the light receiving unit 17-2, the cut sensor 17 allows the cut signal to be transmitted. That is, in order to issue the label sheet 21 as the label capable of being attached, when the user holds and lifts up the label sheet 21 on which the printing is completed and which is hanging down, the cut sensor 17 detects the presence of the label sheet 21 and outputs a signal instructing to cut the label sheet 21. When the control unit 50 determines that the label sheet 21 is detected (Y of S6), the cutter 32 is driven and the label sheet 21 is cut (S7). Thereafter, the discharge roller 35 is continuously driven, and the printed label sheet 21 is discharged from the outlet 14 by the discharge roller 35 and the idler roller 36 (S8). As a result, the printing is finished (S9).

As described above, according to the embodiment, when the user of the printing apparatus 10 holds the printed label sheet 21 and lifts up the label sheet 21 to the detectable range of the cut sensor 17, the cutting of the label sheet 21 is started. Thus, when the issued label is not ready to be received, the label is not cut off.

In addition, according to the embodiment, the discharge roller 35 is provided downstream with respect to the cutter 32. However, even when the discharge roller 35 is not present at that position, as long as the cutting of the label sheet 21 is not performed by the cutter 32, the label sheet 21 does not fall on a floor due to its own weight because the printed label sheet 21 is stopped in a state of being hanging down. Furthermore, in FIG. 8, the cut sensor 17 is described as the reflective sensor, but is not limited to the reflective sensor. For example, a switch (microswitch) that detects an article when a lever formed thereon if pressed by coming in contact with the article may be used as the cut sensor.

Moreover, the cut sensor 17 is provided at a position sufficiently higher than the transport path position of the label sheet 21. Thus, it is possible to prevent the cut sensor 17 from detecting the label sheet 21 when the label sheet 21 is hanging down by its own weight. Furthermore, a detecting side of the cut sensor 17 is only the bottom side. Thus, even when something is placed on an upper side of the cut sensor 17, it is possible to prevent the cut sensor 17 from detecting the article.

Second Embodiment

Hereinafter, a second embodiment will be described.

In the second embodiment, a length of the label to be issued is determined, and further based on the length of the label, whether driving of a cutter is started using a detection signal of a cut sensor or without using the detection signal of the cut sensor.

Figure 9:
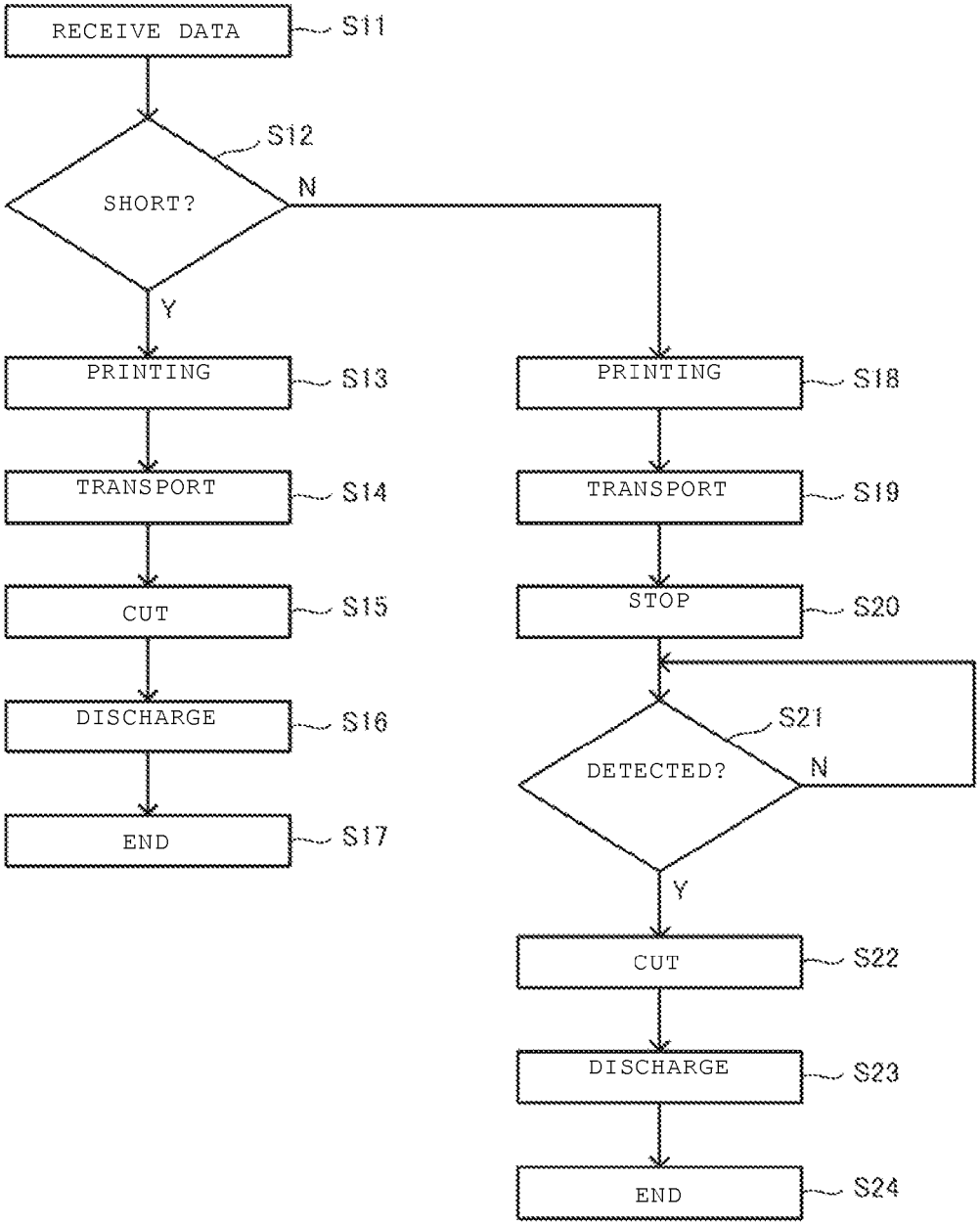
FIG. 9 is a flowchart illustrating a method for issuing a label by a printing apparatus according to a second embodiment.

In the present embodiment, perforations and the like for ease of cutting are not previously performed in a label sheet 21. Thus, the length of the label to be issued may be arbitrarily set. However, when the length of the label is short, a user may not be able to hold the label. Hereinafter, the second embodiment will be described with reference to FIGS. 9 and 10.

Similar to the above description, after the label sheet 21 has been set inside a printing apparatus 10, the printing apparatus 10 receives printing data from a host computer 70 (S11).

A ROM 53 includes a printing label length determination unit (not illustrated), and the printing label length determination unit determines a length of the label on which the printing is going to be performed based on the received printing data, and whether the length of the label is longer than a predetermined length.

Figure 10:
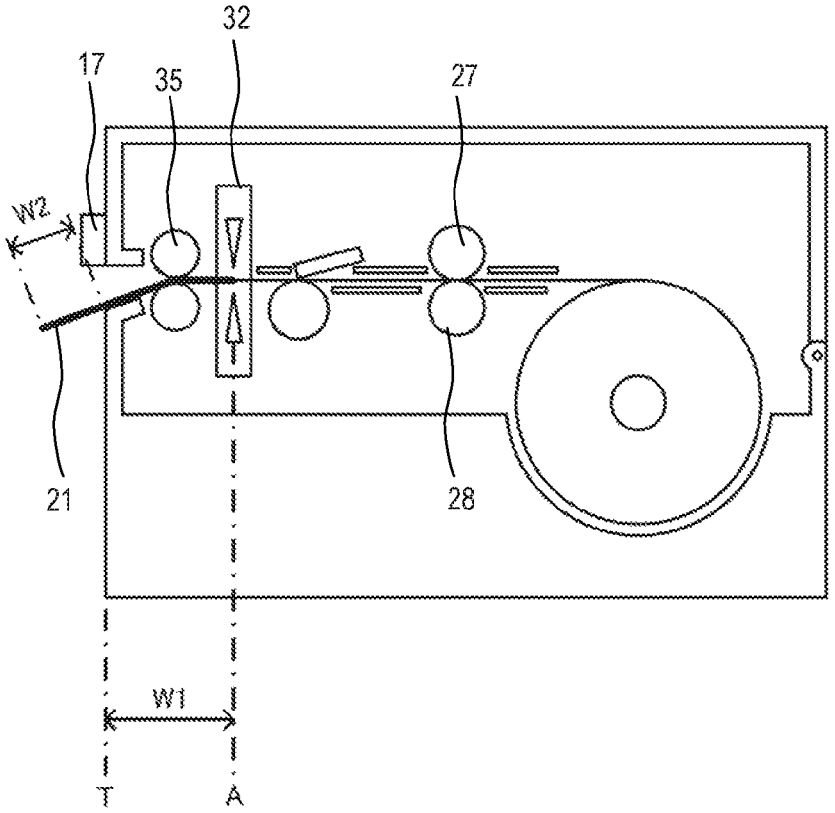
FIG. 10 illustrates an issued label hanging out from the printing apparatus according to the second embodiment.

The predetermined length is described with reference to FIG. 10. The printed label sheet 21 proceeds from a cutter 32 to a discharge roller 35 and then protrudes from an outlet 14 of the printing apparatus 10 to the outside in a state of being hanging down. Here, it is assumed that a distance from a cutting unit A of the cutter 32 to a front end portion T of the outlet 14 is W1, and that a length necessary for a user to hold and lift up the label sheet 21 such that the presence of the label sheet 21 can be detected by the cut sensor 17 is W2. When the length of the printed label sheet 21 is shorter than W1+W2, the user may not be able to hold and lift up the printed label sheet 21 so that the presence of the label sheet 21 is detected by the cut sensor 17. Here, in FIG. 10, W1 is illustrated as a linear distance from the point A to the point T, but as the length W1 is a distance in which the printed label sheet 21 proceeds from the point A to the discharge roller 35 and then reaches the point A in a state of being hanging down, actual length of W1 is slightly longer than the straight line.

When printing is performed on the label according to the received printing data, a printing label length determination unit (not illustrated) determines whether the label length is shorter than W1+W2 (S12). When the label length is shorter than W1+W2 (Y of S12), printing is performed on the label sheet 21 (S13) and then a control unit 50 controls to the feed roller 27 to transport the label sheet 21 to the downstream side between the feed roller 27 and the idler roller 28 and controls the discharge roller 35 to transport the label sheet 21 between the discharge roller 35 and the idler roller 36 (S14). When the label sheet 21 is transported to the cutting position, the label sheet 21 is cut by driving the cutter 32 without waiting for a cutting signal from the cut sensor 17 (S15). The printed label sheet 21 is discharged from the outlet 14 between the discharge roller 35 and the idler roller 36 by continuously driving the discharge roller 35 (S16). As a result, the printing is finished (S17).

Meanwhile, when it is determined that the label length after the printing is longer than W1+W2 (N of S12), the printing is performed on the print surface 22 of the label sheet 21 while transporting the label sheet 21 (S18). Thereafter, the label sheet 21 is transported to the downstream side between the feed roller 27 and the idler roller 28 and then between the discharge roller 35 and the idler roller 36 (S19). Then, the transport is stopped at the cutting position of the label sheet 21 (S20).

Next, the control unit 50 determines whether the cutting signal is output from the cut sensor 17 (S21). When the cutting signal is not detected (N of S21), the process continuously waits until the cutting signal is detected. When the cutting signal is detected (Y of S21), the label sheet 21 is cut by driving the cutter 32 (S22). The printed label sheet 21 is discharged from the outlet 14 between the discharge roller 35 and the idler roller 36 by continuously driving the discharge roller 35 (S23). As a result, the printing is finished (S24).

When the printed label length is shorter than W1+W2, in order for the user to hold and lift up the label sheet 21, it is necessary for the label sheet 21 to be transported downstream from the cutting position. Thereafter, when the user holds and lifts up the label sheet 21 and the cut sensor 17 detects the label sheet 21, since a position of the label sheet 21 to be cut off is located downstream with respect to the cutter 32, the label sheet 21 needs to be reversely conveyed, so that the cutter 32 cuts the label sheet 21 at the correct cutting position, and then is conveyed upstream towards the outlet 14. As a result, it takes time for conveying the label sheet 21 upstream towards the cutter 32 and then again towards the outlet 14.

In contrast, according to the present embodiment, the printing label length determination unit is provided and when the length of the printed label is shorter than W1+W2, the cut is performed without waiting for the cutting signal from the cut sensor 17. To the contrary, when the printed label length is longer than W1+W2, similar to the first embodiment, the cutting is not performed until the user holds and lifts up the label sheet 21 and the cut sensor 17 detects the label sheet 21. Thus, even when the issued label is not ready to be received, the label is not arbitrarily issued. Furthermore, when the issued label is short, it is possible to prevent delay of the issuing time by the additional conveyance of the label sheet 21.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus, comprising:

a housing;

a conveying unit configured to unwind a portion of a rolled sheet and convey the unwound sheet;

a printing unit configured to print an image on the unwound sheet;

a cutter configured to cut off a portion of the unwound sheet; and a sheet sensor configured to detect a portion of the unwound sheet conveyed out of the housing and, upon detecting the portion, output a detection signal that causes the cutter to cut off the unwound sheet.

2. The printing apparatus according to claim 1, wherein the sheet sensor is configured to detect the portion of the unwound sheet when said portion is lifted up and not detect the portion of the unwound sheet when said portion is hanging down.

3. The printing apparatus according to claim 1, wherein the sheet sensor is located above a position where the portion of the unwound sheet is to be conveyed out of the housing.

4. The printing apparatus according to claim 3, wherein a detection direction of the sheet sensor is downward.

5. The printing apparatus according to claim 1, wherein the sheet sensor is located outside of the housing.

6. The printing apparatus according to claim 1, further comprising:

a control unit configured to determine a length of the image to be printed by the printing unit and control the cutter to cut off the portion of the unwound sheet when the length is smaller than a predetermined value, even if the detection signal is not output.

7. The printing apparatus according to claim 6, wherein the predetermined value is greater than a length of a sheet conveyance path between the cutter and an outer wall of the housing.

8. The printing apparatus according to claim 1, further comprising:

a control unit configured to determine a length of the portion of the unwound sheet to be cut off by the cutter and control the cutter to cut off the portion of the unwound sheet when the length is smaller than a predetermined value, even if the detection signal is not output.

9. The printing apparatus according to claim 8, wherein the predetermined value is greater than a length of a sheet conveyance path between the cutter and an outer wall of the housing.

10. The printing apparatus according to claim 1, wherein the conveying unit includes a rotating roller and a driven roller, forming a nip therebetween, and the rotating roller is positioned to contact an outer surface of the unwound sheet, when the unwound sheet is conveyed thereby.

11. A method for printing, comprising:

unwinding a portion of a rolled sheet and conveying the unwound sheet;

printing an image on the unwound sheet;

detecting a portion of the unwound sheet conveyed out of a housing of a printing apparatus; and cutting off a portion of the unwound sheet in response to the detection.

12. The method according to claim 11, wherein the portion of the unwound sheet is detected when said portion that is hanging down outside the housing is lifted up.

13. The method according to claim 11, wherein an upper surface of the portion of the unwound sheet is detected.

14. The method according to claim 11, further comprising:

determining a length of the image to be printed; and when the length is smaller than a predetermined value, controlling a cutter to cut off the portion of the unwound sheet after printing the image.

15. The method according to claim 14, wherein the predetermined value is greater than a length of a sheet conveyance path between the cutter and an outer wall of the housing.

16. The method according to claim 14, wherein when the length is greater than a predetermined value, the portion of the unwound sheet is cut off in response to the detection.

17. The method according to claim 11, further comprising:

determining a length of the portion of the unwound sheet to be cut off; and when the length is smaller than a predetermined value, controlling a cutter to cut off the portion of the unwound sheet after printing the image.

18. The method according to claim 17, wherein the predetermined value is greater than a length of a sheet conveyance path between the cutter and an outer wall of the housing.

19. The method according to claim 11, wherein the unwound sheet is conveyed by a rotating roller that contacts an outer surface of the unwound sheet.

* * * * *